US005117812A

United States Patent [19]

McWhorter

[11] Patent Number: 5,117,812

[45] Date of Patent: Jun. 2, 1992

[54] SEGMENTED COMPRESSION DEVICE FOR THE LIMB

[75] Inventor: Daniel M. McWhorter, Hopkinton

[73] Assignee: The Kendall Company, Mansfield, Mass.

[21] Appl. No.: 608,956

[22] Filed: Nov. 5, 1990

[51] Int. Cl.[5] ..... A61H 1/00

[52] U.S. Cl. ..... 128/24 R; 128/DIG. 20

[58] Field of Search ..... 128/24 R, 25, 26, 87 R, 128/80 R, 165, 166, 882, DIG. 20, 89 R

[56] References Cited

U.S. PATENT DOCUMENTS

| | | | |
|---|---|---|---|
| 3,288,132 | 11/1966 | Meredith | 128/24 R |
| 3,862,629 | 1/1975 | Rotta | 128/24 R |
| 3,892,229 | 7/1975 | Taylor | 128/24 R |
| 3,942,518 | 3/1976 | Tenteris | 128/24 R |
| 4,013,069 | 3/1977 | Hasty | 128/DIG. 20 |
| 4,030,488 | 6/1977 | Hasty | 128/24 R |
| 4,054,129 | 10/1977 | Byars | 128/24 R |
| 4,202,325 | 5/1980 | Villari | 128/DIG. 20 |
| 4,253,449 | 3/1981 | Arkans | 128/24 R |
| 4,311,135 | 1/1982 | Brueckner | 128/24 R |
| 4,402,312 | 9/1983 | Villari | 128/24 R |
| 4,624,244 | 11/1986 | Taheri | 128/24 R |
| 4,841,956 | 6/1989 | Gardner | 128/24 R |

*Primary Examiner*—Robert A. Hafer
*Assistant Examiner*—Michael Brown
*Attorney, Agent, or Firm*—Alvin Isaacs

[57] ABSTRACT

A compression device having a plurality of individual segments separated from each other, each segment having a compression chamber for applying pressure to selected positions of the foot and leg of a patient, a means for intermittently inflating and deflating the compression chamber, a means for releasably securing the segments about a patients limb, and a means for releasably connecting the segments to the inflating means to facilitate rapid connections in time of emergencies.

6 Claims, 1 Drawing Sheet

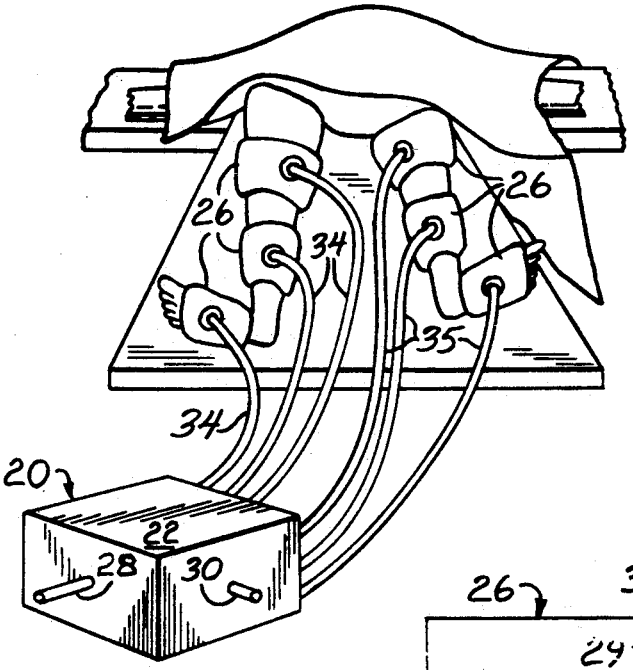
FIG. 1
FIG. 2
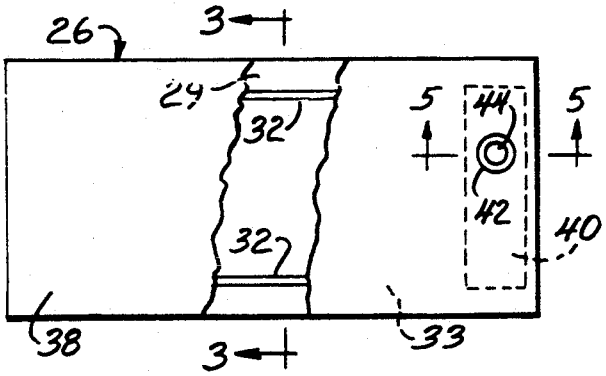
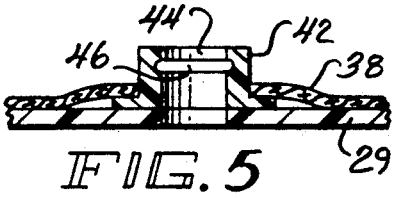
FIG. 5
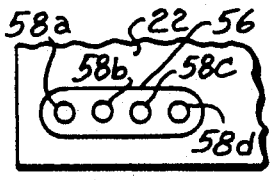
FIG. 6
FIG. 3
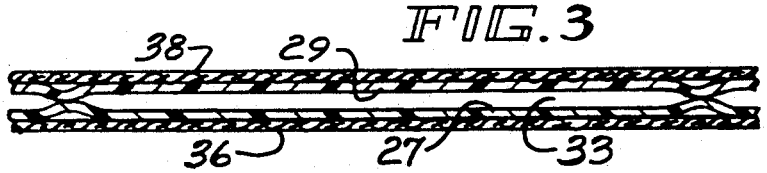
FIG. 4
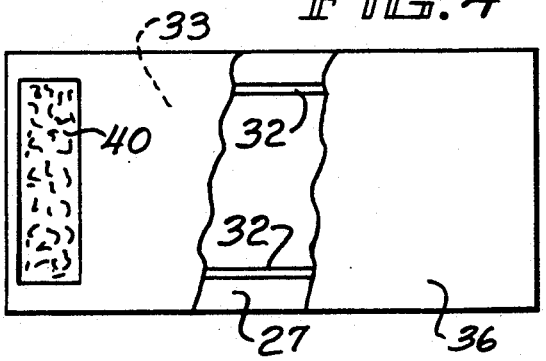
FIG. 7
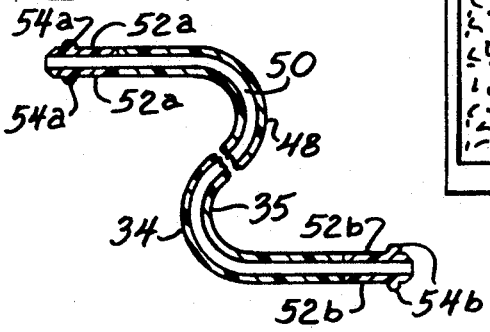

SEGMENTED COMPRESSION DEVICE FOR THE LIMB

BACKGROUND OF THE INVENTION

Prior to the present invention, various compression devices have been known in the art for applying compressive pressure to a patient's limbs in order to increase blood flow velocity. Particularly useful are the SCD (trademark of The Kendall Company, assignee of the present invention) sequential compression devices providing intermittent pulses of compressed air which sequentially inflate multiple chambers in a sleeve, beginning at the ankle and moving up the leg. This results in a wave-like milking action which empties the veins and results in greatly increased peak blood flow velocity, thus providing a non-invasive method of prophylaxis to reduce the incidence of deep vein thrombosis (DVT). These compression devices find particular use during surgery on patients with high risk conditions such as obesity, advanced age, malignancy, or prior thromboembolism. When a DVT occurs, the valves that are located within the veins of the leg can be damaged, which in turn can cause stasis and high pressure in the veins of the lower leg. Patients who have this condition often have swelling (edema) and tissue breakdown (venous stasis ulcer) in the lower leg. It has also been shown that pneumatic compression can be highly effective in the treatment of such edema and venous ulcers. This treatment is usually performed at home on a daily basis.

Devices of the foregoing description are disclosed in various patents of which the following are illustrative: U.S. Pat. Nos. 4,013,069 and 4,030,488 issued to James H. Hasty; U.S. Pat. No. 4,320,746 issued to Edward J. Arkans and Frank K. Villari; and U.S. Pat. No. 4,938,208 issued to John F. Dye, the last-mentioned patent to John F. Dye being particularly directed to units for home treatment.

In general, the compression devices of the prior art comprise a sleeve having plurality of separate fluid pressure chambers progressively arranged longitudinally along the sleeve from a lower portion of the limb to an upper portion. Means are provided for intermittently forming a pressure pulse within these chambers from a source of pressurized fluid during periodic compression cycles. Preferably, the sleeve provides a compressive pressure gradient against the patient's limbs during these compression cycles which progressively decreases from the lower portion of the limb, e.g. from the ankle to the thigh.

Sequential pneumatic compression devices of the foregoing description applying compression to the lower limb have achieved considerable notoriety and wide acceptance as an effective non-invasive means for preventing deep vein thrombosis and for treating venous stasis ulcers.

They function by applying pneumatic compression sequentially and in gradient levels from ankle to thigh for a predetermined time, e.g. 15 seconds, followed by a period of time, e.g. 45 seconds, when no pressure is applied. The particular time period selected is chosen to be optimum for pushing venous blood out of the leg (during the compression cycle) and to allow arterial blood to refill the leg (during the decompression interval).

It has recently been discovered that it may also be advantageous to apply pneumatic compression to the foot to provide significant venous blood movement therefrom. For example, U.S. Pat. No. 4,702,232 and a division thereof, U.S. Pat. No. 4,841,956, of Arthur M. N. Gardner and Roger H. Fox relate to a device for inducing venous-return flow, which device is intended for use on a impaired human leg. In accordance with the teachings of these patents, the cyclical succession of venous pump action which would occur in normal walking is achieved by involuntarily or artificially activating a foot pump followed by artificially induced separate transient operation of a proximal calf pump and then an artificially induced separate operation of a distal calf pump. As disclosed, the pump actions are achieved by providing inflatable bags or cuffs around the foot and upper and lower calf regions, the inflatable cuffs being separately connected by tubes to a fluid pressure supply means. Each cuff is inflated and then deflated before the next cuff is inflated. Moreover, the cuffs are not inflated sequentially from distal to proximal. The sequence disclosed in the patent of foot pump, proximal calf pump and then distal calf pump does not encourage an effective pumping of blood from the leg.

Stated simply, the task of the present invention is to provide an improved compression device which provides more complete venous emptying by permitting selective application of compression to the plantar venous plexus in the foot and to the leg, thereby more effectively obviating the trapping of blood which can occur in the foot veins, particularly during initial compression, as may be the case with the current sequential compression devices applying no sequential compression to the foot region.

BRIEF DESCRIPTION OF THE INVENTION

A principle feature of the present invention is a provision of an improved device for compressing a patient's limb.

The device of the present invention comprises a plurality of segments having chambers for individually covering the foot and leg of a patient, means for separately releasably securing said segments about selected locations of the patient's limbs, means for sequentially inflating the chambers of the segments in an inflation or compression cycle with the most distal segment being inflated first and the most proximal segment being inflated last, and means for thereafter deflating the segments in a deflation or decompression cycle.

A primary feature of the invention is that the compression chambers are provided by individual segments and consequently the individual chamber or chambers whose use is either not desired or is contraindicated for a particular patient may be eliminated.

Another feature of the present invention is that the segments may be placed on the foot and leg of the patient in order to compress the foot and subsequently the leg while the foot remains under compression.

Still another feature of the invention is that the inflating means maintains inflation of one segment while inflating another segment.

A further feature of the invention is that one segment may be placed on more than one location on the limb.

Thus, a feature of the present invention is that the devices is of a simplified construction and reduced cost.

Another feature of the present invention is that the device may be placed on the patient's limb in a simplified manner.

Yet another feature of the invention is the device may be placed in a rapid and efficient manner on the patient's limb.

Thus, a feature of the present invention is that the device may be utilized under emergency conditions.

Still another feature of the invention is that the device may be placed on any of the selected locations on the limb, as desired by the clinician.

Yet another feature of the invention is that the segments may be releasably connected to the inflating means.

Yet another feature of the invention is the device enhances the movement of blood through the patient's limbs.

Yet another feature of the invention is that the device improves blood circulation from the patient's foot into the patient's leg where it is compressed, thereby improving the rate of venous flow toward the heart.

A still further feature of the invention is that the device may be employed to maintain a minimum or base pressure during inflation and deflation.

Still another feature of the present invention is that the device minimizes the possibility of trapping blood in the patient's limb while maximizing the movement of blood through the patient's limb.

Thus, a feature of the present invention is that the device maximizes the volume of blood pumped from the limb.

A feature of the present invention is that the segments may be all the same.

Further features will become more fully apparent in the following description of the embodiments of this invention and from the appended claims.

BRIEF DESCRIPTION OF THE DRAWINGS

In the drawings:

FIG. 1 is a perspective view of a compression device of the present invention;

FIG. 2 is a front plan view, partly broken away, of a sleeve for the device of FIG. 1;

FIG. 3 is a sectional view taken substantially as indicated along the line 3—3 of FIG. 2;

FIG. 4 is a rear plan view, partly broken away, of a device of FIG. 2;

FIG. 5 is a fragmentary section view taken substantially as indicated along the line 5—5 of FIG. 2;

FIG. 6 is a fragmentary elevational view of a portion of a controller for the device of FIG. 1;

FIG. 7 is a fragmentary sectional view of a conduit for the device of FIG. 1.

DESCRIPTION OF THE PREFERRED EMBODIMENTS

Referring now to FIG. 1, there is shown a compression device generally designated 20 having a controller generally designated 22 and a plurality of segments generally designated 26 for placement on a patient's limb such as the leg. While for purposes of illustration, segments for placement only on the foot, calf and thigh are shown, the device may, and preferably will also contain an ankle segment. The controller 22, which per se comprises no part of this invention, may be of a type disclosed in U.S. Pat. Nos. 4,013,069 and 4,030,428 incorporated herein by reference, and sequentially inflates the segments 26 from a source of fluid such as the air from a conduit 28 through conduits 34 and 35, and intermittently connects the chambers of the segments 26 to an exhaust through conduit 30. Alternatively, the air from the individual segments may be vented out onto the skin for cooling.

With reference to FIGS. 2–4, the segments 26 have a pair of inner and outer fluid impervious sheets 27 and 29 e.g. of a suitable plastic polyvinyl chloride, which are joined along lines 32 by suitable means, such as heat sealing, in order to form a chamber 33 in the segments 26. In a suitable form, the chamber 33 (as seen in FIG. 3) may extend substantially the length and width of the segments 26. As shown the segment 26 has an inner flexible coversheet 36 covering an inner surface of the inner sheet 27 in order to provide cover to the patient when the segments 26 is wrapped about the limb. The segment 26 also has an outer oversheet 38 of a loop material, such as a knit fabric, covering an outer surface of the outer sheet 29 for a purpose which will be described below. An elongated hook strip 40 is attached to the inner coversheet 36 along an edge of the segments 26 such that it extends substantially between opposed ends of the segments 26 adjacent the edge of the segments 26, as shown.

In preparation for use, the segments 26 may be wrapped around a selected location of the patient's limb with the inner coversheet 36 facing toward the limb, and the outer coversheet 38 facing away from the patient's limb, such that the hook strip 40 may be located over a desired position on the outer coversheet 38 and may be releasably attached to the outer coversheet 38 in order to releasably secure the strip 40 to the outer coversheet 38 and thereby releasably attach the segments 26 to the patient's limb. Thus, the segments 26 may be adjustably secured about the patient's limb in a releasable manner, with the strip 40 being releasably secured to any desired location on the outer coversheet 38, such that the segments 26 may accommodate any suitable diameter of a patient's limb, such as the foot or leg, and the segments 26 may be releasably secured at a selected location on the patient's limb. Thus, the segments 26 may be located on the patient's foot, ankle, calf, or thigh, as desired. In addition, the segments 26 may be rapidly placed in a simplified manner on the patient's limb, such as in an emergency situation, in order to facilitate wrapping of the patient's limb preparatory to use. Of course, the segments 26 may be similarly unwrapped in a rapid and simplified manner.

In addition, with reference to FIGS. 2 and 5, the segments 26 include an annular connecting member 42 being secured to an outer surface of the outersheet 30, with the connecting member 42 having a bore 44 in communication with the chamber 33. As shown, the connecting member 42 has an annular groove 46 for a purpose which will be described below.

With reference to FIG. 7, the device 20 may have a plurality of conduits 34 and 35, having an elongated tubular section 48 having a channel 50 extending therethrough, with the tubular section 48 having a pair of hollow connecting members **52*a* and 52*b* at opposed ends of the tubular section 48. The connecting members 52*a* and *b* may have outwardly directed annular rims 54*a* and 54*b* for use in connecting the conduits 34 and 35, which may be the same. Of course, in a preferred form, the connecting members 52*a* and *b* at the opposed ends of the conduits 34 and 35 ar identical in order to simplify the construction of the conduits 33 and 35. With reference to FIG. 6, the controller 22 may have a connecting block 56 having a plurality of bores in the connecting block 56 in order to establish communication with the controller 22 and the fluid source through conduit 28, previously described in connection with FIG. 1, such that either one of the connecting members 52***a* and *b* may be placed in any of the bores 58*a, b, c,* or *d* in order to establish communication with the controller 22 through the respective bore 58*a–d*. The other connecting member 52*a* and *b* of the conduit 34 and 35 may be placed in the connecting member 42 of the segment 26, with the respective rim 54*a* and *b* of the connecting member 52*a* and *b* being releasably received in the bore 44 of the connecting member 42. Thus, the conduits 34 and 35 may be releasably connected to the segments 26 and bores 58*a–d* of the connecting block 56 of the controller 22 in a simplified manner providing placement of the connecting members 52*a* and *b* of the conduits 34 and 35 and the connecting members 42 of the segments 26 and the connecting block 56 of the controller in any desired manner or order. Thus, the segments 26 may be rapidly and efficiently connected in a simplified manner through use of the cooperating conduits 34 and 35 in order to establish communication between the segments 26 and controller 22 in an emergency situation, if desired.

In addition, the segments 26 on the limb, such as the foot and the leg, as shown in FIG. 1, including the foot, ankle, calf, and thigh, will be connected to the controller 22, such as that the controller 22 sequentially inflates the segments 26 on the limb of the patient from distal to proximal. In particular, the segments 26 may be rapidly placed on a patient in an emergency situation, such as in the emergency room, and the segments may be placed over the desired location of the patient's limb and rapidly connected to controller 22 in order to produce the desired inflation of the segments 26. An important advantage of the present invention is that where the treatment so requires, e.g. where there is an injured area of the leg, not all the segments need be attached to apply compressive pressure. Accordingly, only those segments which the physician or other clinician chooses to employ need be connected so as to be inflatable. Alternately, the controller may be programmed to inflate only the selected segments. It is desirable to initially inflate the foot in order to facilitate or enhance movement of blood from the foot into the patient's leg and prevent trapping of fluid in the patient's limb during operation of the device. Subsequently, it is desirable to sequentially inflate or compress the patient's leg from a distal location to a proximal location of the patient's limb relative to the heart, such that the limb is sequentially inflated from a location adjacent the ankle to the patient's thigh in order to enhance the movement and blood through the patient's leg. In this manner, the patient's limb is compressed in a sequence starting from the foot to a location adjacent the ankle toward the patient's thigh in order to minimize the trapping of blood in the patient's limb while maximizing the movement of blood through the patient's leg. In this manner, the volume of blood pumped through the patient's limb is enhanced while minimizing the amount of trapped blood in a patient's limb. However, in an emergency situation, the segments 26 may be placed at any of the desired locations on the patient's foot or patient's leg in a rapid and simplified manner, as desired. The order of sequential inflation of the segments 26 may be selected through attachment of the conduits 34 and 35 to the particular bores 58*a, b, c, d* of the connecting block 56 of the controller 22 which are predetermined in order by the controller 22 in sequential inflation, or the order of sequential inflation to the bores 58*a–d* of the connecting block 56 may be selected on a suitable panel of the controller 22 after attachment of the segments 26 to the controller 22 through the conduits 34 and 35, as desired. In the preferred form, all of the segments 26 may be of the same construction and size, and the segments 26 may be secured about any of the locations of the patient's limb through the use of identical conduits 34 and 35 in conjunction with the controller 22 in order to minimize the numbers of components of the device 20, and provide a device 20 of simplified construction and reduce cost. Moreover, since only those bores to which a conduit is attached become activated, where desired, e.g., in case of an injury, less than the total number of segments may be attached.

Apart from the significant advantages of simplified construction and cost reduction, the individual segment design of the present invention permits the practitioner the option to omit one or more segments so as not to interfere with a surgical site or cause pain by applying compression to a wound. In other words, the present invention provides the flexibility to employ less than all of the segments in applying compressive pressure to the leg where medical or surgical factors and/or procedures indicate that one or more of the segments should not be utilized.

During inflation, the controller 22 preferably maintains inflation of one segment while inflating another segment, as previously discussed. In addition, it will be apparent that any given segment 26 may be placed on more than one location of the limb, and the segments 26 are adjustably closed about the limb, while the segments 26 are releasably attached to the controller 22. If desired, a minimum or base pressure may be maintained in each segment throughout the operation of the device, i.e. during the inflation and deflation cycles. This base pressure may be substantially the same for each segment, e.g. on the order of 10 mm of mercury.

Alternatively, the base pressure may be progressively less proximally from segment to segment. For example, the foot segment may have a base pressure on the order of 10 mm of mercury, the ankle segment a base pressure on the order of 8 mm, the calf segment on the order of 6 mm and the thigh segment on the order of 4 mm.

From the foregoing description it will be seen that the present invention provides an elegant design which enables the practitioner or clinician to use any or all of the segments to apply compressive pressure to the leg. Irrespective of the number of segments utilized, as is known in this art, each compression cycle is followed by a decompression cycle during which the chambers of the segments are deflated. As is understood, the sequence of compression as well as the time for each compression and decompression cycle is controlled by controller 22. Preferably, the controller provides a gradation in compressive pressure with the greater pressure at the distal end of the leg decreasing towards the proximal portion.

As described above, in lieu of complete deflation of the chambers of the segments, it is contemplated that in some procedures it may be desirable to maintain a baseline pressure over which additional pressure is intermittently applied during the compression cycles.

As heretofore alluded to, the patent literature is replete with references to sequential compression devices. In general, any of the modifications described and claimed in these prior patents may be incorporated into the novel device of this invention.

For instance, a ventilation chamber may be included, as disclosed in U.S. Pat. No. 4,091,804 of James H. Hasty or U.S. Pat. No. 4,481,937 of Edward J. Arkans.

Other modifications which may be made included, but are not limited to the following: providing concurrent rather than sequential inflation (compression) from a single pulse to apply a gradient from ankle to thigh, as described in U.S. Pat. No. 4,030,488 of James H. Hasty; providing means for monitoring the pressure in the sleeves, as disclosed in U.S. Pat. No. 4,331,133 of Edward J. Arkans; sensing the pressure in the chambers and then venting to prevent over-pressurizing, as taught in U.S. Pat. No. 4,396,010 of Arkans; and including an arterial thrombosis detection system, as disclosed in U.S. Pat. No. 4,574,812 of Arkans. Other changes and additions will be readily suggested to those skilled in the art in the light of the foregoing description. For instance, while in the illustrative drawing the foot segment 26 is shown to generally cover the arch and instep, it may also be adapted to cover the heel as well.

While the present invention is primarily directed to preventing deep vein thrombosis which can occur while a patient is bedridden, e.g. following surgery, it also may find utility in inhibiting edema, particularly lymphedema, a chronic unilateral or bilateral edema of the legs due to accumulation of interstitial fluid as a result of stasis of lymph, which is secondary to obstruction of lymph vessels or disorders of the lymph nodes.

By way of recapitulation, it will be seen that the present invention provides an improved compression device for the limb in that it permits a more complete venous emptying or return of the leg since it includes compression to the plantar venous plexus.

For this reason, trapping of venous blood in the foot veins during compression is obviated. This advantage distinguishes the present invention over the foot pumps of the prior art such as those described in the aforementioned U.S. Pat. Nos. 4,702,232 and 4,841,956 of Gardner and Fox in that the present invention provides a more complete emptying of the limb veins, particularly at the valve cusp, a locus particularly susceptible to stasis.

The foregoing detailed description is given for clearness of understanding only and no unnecessary limitations should be understood therefrom, as modifications will be obvious to those skilled in the art.

What is claimed is:

1. A compression device comprising:

a plurality of segments, said plurality of segments are individual segments each having a compression chamber and separated from each other for applying pressure to selected locations of the patient's limb;

a means for intermittently inflating and deflating the chambers of said segments;

a means for releasably securing said segments about a patient's limb; and a means for releasably connecting said segments to the inflating means, the means for releasably connecting the segments comprising;

a conduit having an elongated tubular section having a channel extending there through, said tubular section having a pair of hollow connecting members at opposed ends, said connecting members having outwardly directing annular rims;

a annular connecting member having a bore in communication with said chamber of said segment, said bore having an annular groove for releasably receiving said annular rims of said hollow connecting members of said conduit, said annular connecting member secured to the outer surface of said segment; and a connnecting block having a plurality of bores for releasably receiving said hollow connecting members, said connecting block attached to said inflating means with said bores of said connecting block in communication with said inflating means.

2. A device as claimed in claim 1 wherein said individual segments are independently inflated and deflated.

3. A device as claimed in claim 1 wherein a minimum base pressure is maintained in the individual chambers of said individual segments.

4. A device as claimed in claim 3 wherein said base pressure is on the order of 10 mm Hg.

5. A device as claimed in claim 3 wherein said base pressure increases from a distal segment to a proximal segment.

6. A connector for making rapid connections between an inflating means and an individual segment having a compression chamber comprising:

a conduit having an elongated tubular section having a channel extending therethrough, said tubular section having a pair of hollow connecting members at opposed ends, said connecting members having outwardly directing annular rims;

an annular connecting member having a bore in communication with said compression chamber of said segment, said bore having an annular groove for releasably receiving said annular rims of said hollow connecting members of said conduit, said annular connecting member secured to the outer surface of said segment; and a connecting block having a plurality of bores for releasably receiving said hollow connecting members, said connecting block attached to said inflating means with said bores of said connecting block in communication with said inflating means.

* * * * *